US009080389B2

(12) United States Patent
Vandenbulcke et al.

(10) Patent No.: US 9,080,389 B2
(45) Date of Patent: Jul. 14, 2015

(54) METHOD AND DEVICE FOR DRILLING SHAFTS IN GROUND LAYERS CONSISTING OF ROCK, CLAY AND/OR RELATED MATERIALS

(75) Inventors: Luc Vandenbulcke, Antwerp (BE); Bart Achiel Alfons De Poorter, Melle (BE); Koen Vanderbeke, Erps-Kwerps (BE)

(73) Assignee: GeoSea NV, Zwijndrecht (BE)

( * ) Notice: Subject to any disclaimer, the term of this patent is extended or adjusted under 35 U.S.C. 154(b) by 717 days.

(21) Appl. No.: 13/257,256

(22) PCT Filed: Mar. 18, 2010

(86) PCT No.: PCT/EP2010/053514

§ 371 (c)(1), (2), (4) Date: Nov. 29, 2011

(87) PCT Pub. No.: WO2010/106124

PCT Pub. Date: Sep. 23, 2010

(65) Prior Publication Data

US 2012/0118644 A1 May 17, 2012

(30) Foreign Application Priority Data

Mar. 19, 2009 (BE) ..... 2009/0177

(51) Int. Cl.

| | |
|---|---|
| ***E21B 21/00*** | (2006.01) |
| ***E21B 7/20*** | (2006.01) |
| ***E21B 7/18*** | (2006.01) |
| ***E21B 21/12*** | (2006.01) |
| ***E21B 21/14*** | (2006.01) |

(52) U.S. Cl.

CPC ... *E21B 7/20* (2013.01); *E21B 7/18* (2013.01); *E21B 21/12* (2013.10); *E21B 21/14* (2013.01)

(58) Field of Classification Search

CPC ..... E21B 7/18; E21B 7/20; E21B 21/12; E21B 21/14

USPC ..... 175/67, 65, 424, 215

See application file for complete search history.

(56) References Cited

U.S. PATENT DOCUMENTS

| | | | | |
|---|---|---|---|---|
| 3,454,119 A | | 7/1969 | McClinton | |
| 3,674,100 A | | 7/1972 | Becker | |
| 4,534,426 A | * | 8/1985 | Hooper | 175/65 |
| 5,586,609 A | * | 12/1996 | Schuh | 175/65 |

FOREIGN PATENT DOCUMENTS

| | | |
|---|---|---|
| DE | 124203 | 8/1899 |
| EP | 0496481 | 7/1992 |
| EP | 0543140 | 5/1993 |

* cited by examiner

*Primary Examiner* — Nicole Coy

(74) *Attorney, Agent, or Firm* — Bret E. Field; Daniel G. Stoddard; Bozicevic, Field & Francis LLP

(57) ABSTRACT

The invention relates to a method for drilling shafts (2) in ground layers (3). The method comprises of arranging a borehole casing (4) in the ground (3), lowering into the borehole casing (4) a hollow drill string (5) provided with a drill head (7) with cutting tools (8), arranging a water column (10) in the borehole casing (4), and then setting the drill string (5) into rotation (20) in the borehole casing (4) so that ground material (31) is dislodged by the cutting action of the cutting tools (8). At the position of the drill head (7) a first fluid (26) is injected under a first pressure into the ground layers (3) by means of one or more nozzles (25). The method has a higher drilling efficiency than the known method. The invention also relates to a device for performing the method, and a jack-up pontoon provided with the device.

25 Claims, 2 Drawing Sheets

METHOD AND DEVICE FOR DRILLING SHAFTS IN GROUND LAYERS CONSISTING OF ROCK, CLAY AND/OR RELATED MATERIALS

INTRODUCTION

The present invention relates to a method and device for drilling shafts in ground layers consisting of rock, clay and/or related materials. The phrase "rock, clay and/or related materials" is understood to mean diverse types of ground which can form the ground layers of a water basin or a land area up to a very variable depth. Such ground layers for instance form part of sea arms, streams and rivers, docks, storage reservoirs, access channels to locks or inlet docks. Rocky bottoms also fall within these types of ground.

Drilling a shaft can for instance be necessary in order to arrange piles in the ground or to realize piles by filling the shaft with a binder during or after the drilling, and curing this binder.

BACKGROUND

A known method for the drilling cavities or shafts in ground layers consisting of rock, clay and/or related materials comprises of arranging a borehole casing in the ground, lowering into the borehole casing a hollow drill string provided with a drill head with cutting tools, then setting the drill string into rotation in the borehole casing so that ground material is dislodged by the cutting action of the cutting tools, and discharging the dislodged ground material, for instance by suctioning through the cavity of the drill string.

The known method has the drawback, among others, that during drilling in cohesive ground layers, such as for instance in clay, ground material remains adhered to the drill head, whereby its cutting action is impeded. Not only is less ground material dislodged, the discharge of the dislodged ground material is moreover obstructed. Both effects result in a reduced drilling efficiency. Similar problems otherwise occur when drilling in cracked rock and in compact sand layers.

SUMMARY

The invention has for its object to provide a method and device for drilling shafts in ground layers consisting of rock, clay and/or related materials, which at least partially obviate the above stated and other drawbacks.

EP-A-0543140 relates to a method and device for forming cement pilings into a ground. In the disclosed method, ground material is removed by rotating a drill head with cutting tools in a borehole casing. In the bored hole a hardenable cement mixture is injected in the ground, which cement mixture is provided through the hollow drill string. The injected cement mixture forms a cement piling in the ground after hardening. A shaft casing provided with a drill head is used to control the transverse dimensions of the formed puling by counter rotating the casing with respect to the drill string, which prevents the drill string from deviating from its central axis.

U.S. Pat. No. 3,674,100 relates to impact drilling using a drilling apparatus provided with an anvil. The device of U.S. Pat. No. 3,674,100 employs a hollow double walled drill pipe provided in a casing. While the anvil is subjected to impact energy, compressed air is passed down the annular passage between the walls of the drill pipe into an axial bore of the drill bit, while water is passed between the drill pipe and the casing. The water passes into the axial bore of the bit and upwardly though the cavity of the hollow drill pipe to discharge cut material.

The invention has for its object to provide a method and device for drilling shafts in ground layers consisting of rock, clay and/or related materials, which at least partially obviate the above stated and other drawbacks.

The invention provides for this purpose a method for drilling shafts in ground layers consisting of rock, clay and/or related materials, comprising of arranging a borehole casing in the ground in a manner such that it admits substantially no water on its underside, arranging a water column in the borehole casing, lowering into the borehole casing a hollow drill string provided with a drill head with cutting tools, then setting the drill string into rotation in the borehole casing so that ground material is dislodged by the cutting action of the cutting tools and is discharged using a flow maintained by the water column in the hollow drill string, with the proviso that at the position of the drill head a first fluid is injected under a first pressure of at least 200 bar, into the ground layers by means of one or more nozzles.

It has been found that with the method according to the invention the drilling efficiency is increased markedly relative to the known method, among other reasons due to a reduced adhesion of ground material to the drill head.

According to the invention a water column is arranged in the space between the substantially coaxially disposed borehole casing and drill string. This water column provides for a pressure difference between the upper side and the underside of the drill string, wherein the pressure is of course higher on the underside. A flow is hereby maintained in the hollow drill string, in which flow the dislodged ground material is discharged to the upper side of the drill string. In order not to lose the water pressure, the borehole casing is arranged in a manner way that it admits substantially no water on its underside. For this purpose the borehole casing is generally placed on or in the (water) bottom, so creating a good seal and water sealing at the lower outer end of the borehole casing. Because the drill string with drill head must be received in the borehole casing, the borehole casing has a larger diameter than the drill head. In order to still be able to allow the borehole casing to penetrate the ground use is generally made of so-called underreaming. In underreaming the drill string is provided on the drill head outer end with a construction having radially fold-out side arms. When drilling is carried out with the arms in the folded-out position a borehole will be created which is wider than the diameter drilled by the drill head. The ground directly beneath the borehole casing is hereby drilled away and the borehole casing can be moved even deeper into the ground, for instance in order to obtain a better sealing with the ground. Underreaming is also applied when a wider foot must be drilled in order to obtain extra pile bearing capacity or anchoring. A drawback of underreaming is however that the construction used for this purpose is complex and vulnerable. The presence of the underreaming construction can moreover reduce the drilling efficiency. There is also a risk that falling debris can block the mechanism of the protruding arms, whereby it becomes impossible to once again remove the drill string from the borehole. This is of course highly undesirable.

A preferred embodiment of the method according to the invention is characterized in that the nozzles are positioned such that they inject the first fluid substantially radially outward into ground layers situated at a greater depth than the lower outer end of the borehole casing. It has been found that this preferred embodiment renders the use of an underreaming construction unnecessary, whereby the above stated problems are prevented. The radially outward directed first fluid jets do indeed ensure that the ground is at least partially removed or weakened at the position of the underside of the borehole casing, so that the borehole casing can move deeper into the ground. An extra advantage hereof is that less deep drilling is necessary in order to achieve the same shaft depth.

Another preferred embodiment of the invented method is characterized in that the first fluid is injected under a first pressure of at least 350 bar, more preferably at least 500 bar and most preferably at least 650 bar. Such high to very high pressures are found to further support the intended increase in efficiency.

According to a preferred embodiment of the invented method, a second fluid is also injected under a second pressure into the hollow drill string at the position of the drill head. The second fluid preferably has a lower density than water, whereby this second fluid rises and expands in the drill string, thus further supporting the upward flow. A particularly suitable second fluid comprises air. The second pressure can be varied within wide limits, although the drilling efficiency is optimal when the second pressure lies between 2 and 50 bar, more preferably between 4 and 30 bar, and most preferably between 6 and 20 bar.

It is further advantageous that the nozzles co-rotate with the drill head during injection of the first fluid, for instance by being connected to the drill head. The first fluid can comprise any injectable substance, although particularly suitable is water to which additives, such as for instance abrasive agents, are added if desired.

The invention also relates to a device for performing the above described method. The features of the device are described in the appended claims. Other details and advantages of the invention will become apparent from the following description of a method and a device for drilling shafts in ground layers consisting of rock, clay and/or related materials. This description is given solely by way of example, without the invention being limited thereto. The reference numerals relate to the accompanying figures. In the figures:

DETAILED DESCRIPTION

Figure 1:
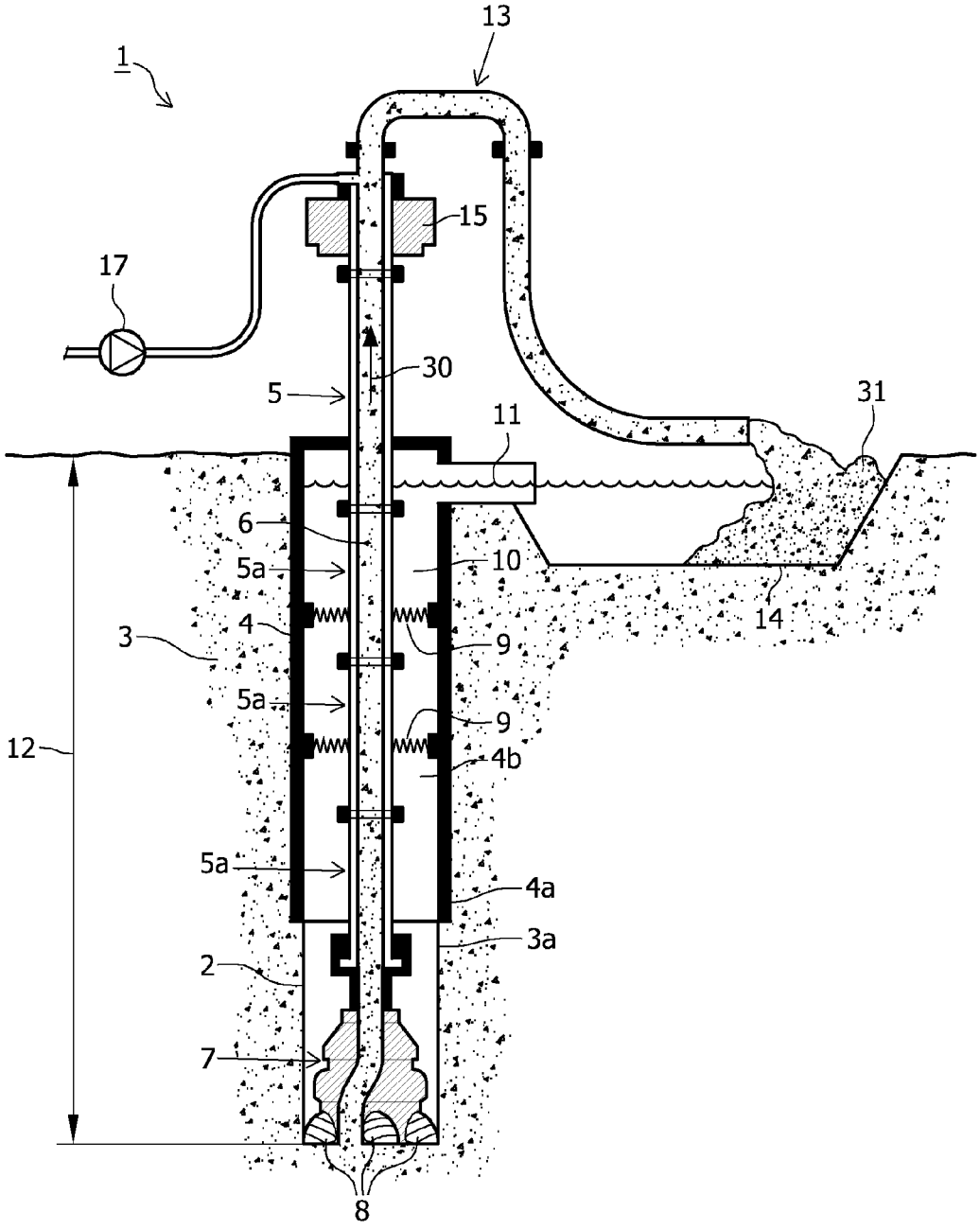
FIG. 1 shows a schematic representation of a device according to the invention.

Referring to FIG. 1, a device 1 is shown for drilling a shaft 2 in a ground layer 3. Ground layer 3 preferably comprises rock, but may also comprise clay and/or related materials. Device 1 comprises a borehole casing 4 which can be arranged in ground 3 in known manner by means which are not shown. The diameter of borehole casing 4 is in principle all but unlimited, though preferably amounts to at least 1 m, more preferably at least 2 m, still more preferably at least 4 m and most preferably at least 6 m. Arranging borehole casing 4 in ground 3 can for instance take place by means of driving and/or drilling Because borehole casing 4 supports on its underside 4*a* on a ground layer 3*a*, a substantially water-impermeable sealing is achieved. Borehole casing 4 generally comprises a thick-walled steel tube which is suitable for placing a drilling installation on the top side thereof and which remains substantially stationary during the drilling.

Borehole casing 4 is sufficiently large to provide space for a drill string 5. Drill string 5 comprises a number of borehole casings 5*a* mutually connected by means of flanges. Hollow borehole casings 5*a* together form a central cavity 6. Drill string 5 is provided on the underside with a drill head 7 with cutting tools 8, for instance in the form of cutting discs. In order to increase the weight of the drill head, drill string 5 can if desired be provided with weighting collars (not shown), although this is not essential. In order to prevent outward buckling of drill string 5 during drilling, drill string 5 is preferably provided with a number of stabilizers 9 which are arranged distributed in axial direction and which support against inner wall 4*b* of borehole casing 4. Device 1 also comprises means for maintaining a water column 10 in borehole casing 4, for instance in the form of a pump (not shown) with sufficient rise height and flow rate (typically for instance 1000 m3/h) so as to maintain the highest possible water level 11 in borehole casing 4. Device 1 further comprises means for setting drill string 5 into rotation in borehole casing 4. Such means preferably comprise a transmission in the form of a swivel 15 provided with a drive (not separately shown). By setting drill string 5 into rotation on the top side thereof, and through the relatively stiff coupling of borehole casings 5*a*, the drill head is also set into rotation in drilling direction 20 (see FIG. 2), whereby ground 3 is crushed by the action of cutting tools 8. Although borehole casing 4 and drill string 5 run practically vertically in the shown figures, they can be adjusted to any angle relative to the ground surface, this from a jack-up platform or pontoon or from the shore when the device forms part of for instance a vehicle.

In the shown preferred variant a water column 10 is arranged in the space between the substantially coaxially disposed borehole casing 4 and drill string 5. This water column 10 provides for a pressure difference 12 between the upper side of drill string 5 at the position of water level 11 and the underside of drill string 5 at the position of cutting tools 8, wherein the pressure is of course higher on the underside. Owing to this pressure difference 12 and because borehole casing 5 is open on the underside, so that a throughfeed is possible to cavity 6, water and loosened ground material 31 flow in the direction indicated by arrows 22 and 23 into cavity 6. An upward flow 30 is thus maintained in cavity 6 of drill string 5, in which flow 30 the loosened ground material 31 (see FIG. 2) is discharged to the top side of drill string 5, where it is discharged to for instance a storage reservoir 14 via an overflow 13. The water pressure is substantially maintained due to the substantially water-tight sealing between underside 4*a* of borehole casing 4 and ground 3*a*.

In order to further increase the discharge of loosened ground material 31 through cavity 6 of borehole casing 5, the shown preferred variant also comprises means for injecting air under a second pressure into the hollow drill string 5 at the position of drill head 7. These means comprise feed lines 16 which are arranged on drill string 5 and which are connected at the one outer end to a compressor 17 and which debouch at the other outer end into cavity 6 of drill string 5 via air inlet valves 18 (see also FIG. 2). Compressor 17 ensures that air is carried under a certain pressure through lines 16 in the direction indicated by arrows 19 and enters flow 30 (indicated by arrows 40). Because the compressed air has a lower density than the water flowing in cavity 6, the air rises as bubbles 21 in drill string 5, whereby the flow in the direction indicated by arrow 22 is further supported. The drilling efficiency is hereby increased. The second pressure produced by compressor 17 preferably lies between 2 and 50 bar, more preferably between 4 and 30 bar, and most preferably between 6 and 20 bar.

Figure 2:
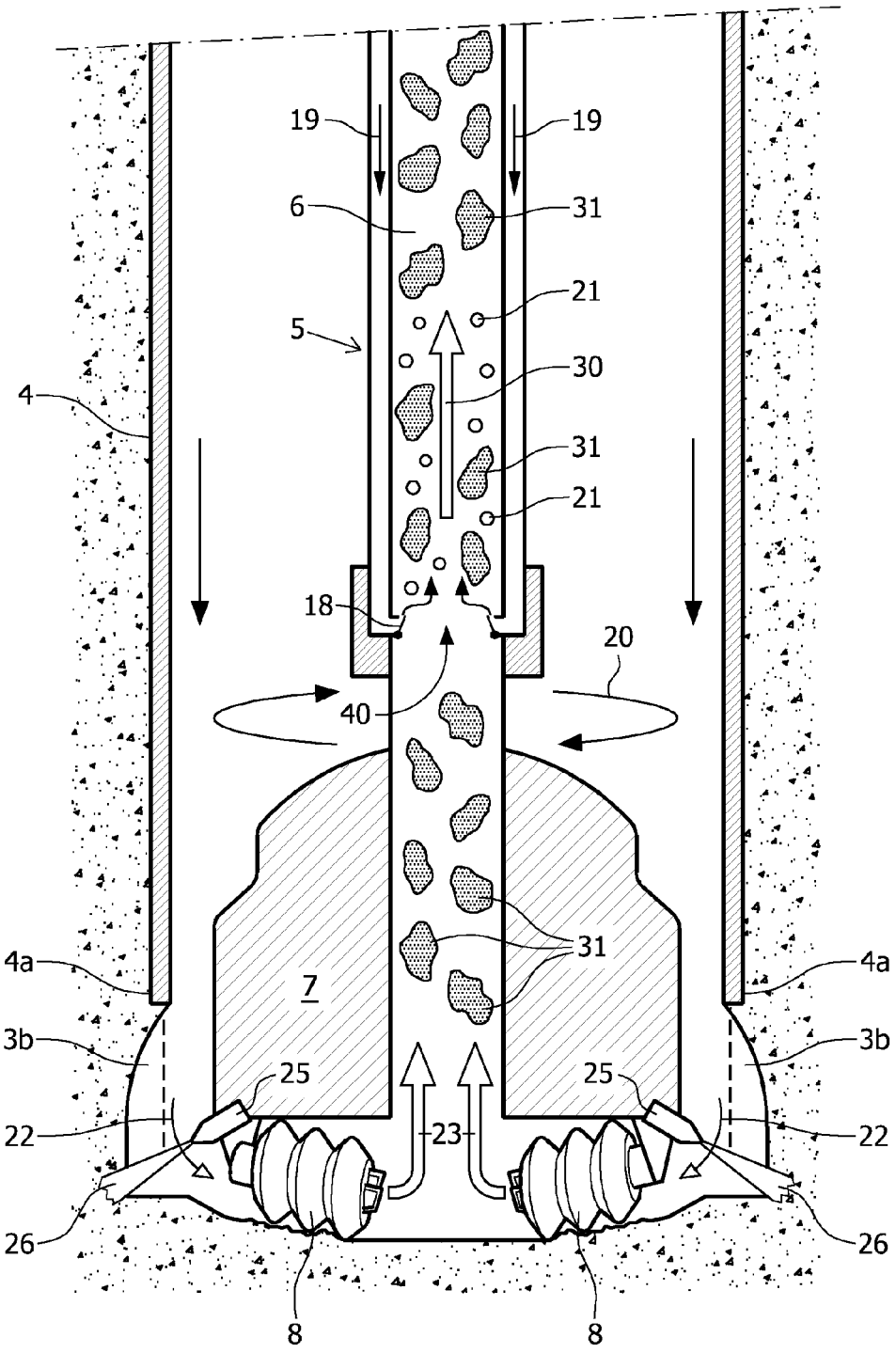
FIG. 2 shows a schematic side view of a rotating drill head equipped with nozzles according to the invention.

Device 1 according to the invention is further provided with one or more nozzles 25 (see FIG. 2) for injecting a first fluid, preferably water, under a first pressure into ground layers 3 at the position of drill head 7. Drill string 5 and/or borehole casing 4 and/or drill head 7 are provided with conduits (not shown) for feeding the first fluid to the nozzles. The conduits are connected to pressure means such as a pump or compressor for bringing the first fluid under pressure. As shown in FIG. 2, the nozzles are preferably mounted on drill head 7 so that they co-rotate with the drill head, although mounting on for instance drill string 5 and/or on borehole casing 5*a* is likewise possible. Nozzles 25 are suitable for injecting the water under a first pressure of at least 200 bar, preferably at least 350 bar, more preferably at least 500 bar and most preferably at least 650 bar. In the embodiment shown in FIG. 2 the nozzles are directed substantially radially outward, whereby water jets 26 are injected into ground layer 3 at a greater depth than the lower outer end 4*a* of borehole casing 4. Extra ground material 3*b* is hereby removed or at least weakened at the position of underside 4*a* of borehole casing 4, whereby borehole casing 4 can move deeper into the ground 3. An underreamer construction is hereby no longer necessary. An additional advantage of injecting water under high pressure is that additional material (such as ground material 3*b*) is hereby loosened, whereby more loosened ground material reaches cavity 6 in the direction of arrows 22 and 23, and the drilling efficiency is increased.

The transmission (swivel 15) is designed such that it can transfer a first fluid flow under high pressure from the stationary to the rotating part of the device. Transmission 5 is therefore preferably suitable for withstanding an internal pressure of at least 200 bar, more preferably at least 350 bar, still more preferably at least 500 bar and most preferably at least 650 bar, and is preferably leak-proof at such pressures. Swivel 15 is further suitable for transmitting the necessary torque from the stationary to the rotating part of the device in order to transmit the second pressure to conduits 19, as well as for discharging the water—ground material mixture (30, 31). Swivel 15 is further suitable for retaining these properties under the influence of the vibrations which inevitably occur during the drilling, and which only increase as drill head 7 penetrates further into ground layers 3.

The placing and orientation of nozzles 25 can be chosen as a function of the type of ground. It is therefore advantageous to mount nozzles 25 releasably on drill head 7 and/or drill string 5 so that they can be easily displaced. It is also advantageous to mount nozzles 25 movably, for instance pivotally, on drill head 7 and/or drill string 5, so that the fluid jets can be aimed in simple manner. It is further advantageous to place nozzles 25 such that they can approach relatively closely the ground layers for cutting. The cutting efficiency of nozzles decreases quickly under water, and is generally already negligible after several decimeters. The device according to the invention preferably further comprises means which make it possible to choose which nozzles must be activated at which moment, this subject to the properties of the ground layer for drilling.

The feed lines for the first and second fluid can be long, particularly in the case of drilling at great depth. These lines are preferably carried substantially without bends from the upper side of device 1 to the lower part of drill string 5 (and/or drill head 7). Pressure losses are hereby prevented as far as possible.

The invented device and method are particularly suitable for drilling shafts of relatively large diameters in composite grounds so as to enable forming and/or arranging of foundation piles therein. In addition, the device and method provide a new method of (hydraulic) underreaming. Arranging nozzles on the underside of the drill head ensures that cutting tools are less likely to become stuck fast in the ground layers. Arranging nozzles on the side of the drill head ensures that the diameter of the borehole under the borehole casing is increased, so that use of a vulnerable underreamer is no longer necessary.

It has been found that by injecting a first fluid such as water under high pressures of typically 400 bar, composite ground such as clay ground, but also eroded rocky ground, can be cut with improved efficiency (for instance by 7% and more). At even higher pressures of more than 650 bar relatively soft rocks can also be crushed with improved efficiency. The device and method are particularly suitable for drilling in composite ground and eroded rock with compression strengths up to about 5 MPa.

The invention is not limited to the embodiment described here, and many modifications could be made thereto, to the extent these modifications fall within the scope of the appended claims.

The invention claimed is:

1. A method for drilling shafts in ground layers consisting of rock, clay and/or related materials, comprising arranging a borehole casing in the ground in a manner such that it admits substantially no water on its underside, lowering into the borehole casing a hollow drill string provided with a drill head with cutting tools, arranging a water column in the borehole casing, then setting the drill string into rotation in the borehole casing so that ground material is dislodged by the cutting action of the cutting tools and is discharged using a flow maintained by the water column in the hollow drill string, wherein at the position of the drill head a first fluid is injected under a first pressure of at least 200 bar into the ground layers by one or more nozzles, the nozzles being positioned such that they inject the first fluid outward into ground layers situated at a greater depth than a lower outer end of the borehole casing.

2. The method as claimed in claim 1, characterized in that a second fluid is injected under a second pressure into the hollow drill string at the position of the drill head, thereby supporting the upward flow.

3. The method as claimed in claim 2, characterized in that the second pressure lies between 2 and 50 bar.

4. The method as claimed in claim 2, characterized in that the second fluid comprises air.

5. The method as claimed in claim 2, characterized in that the second pressure lies between 4 and 30 bar.

6. The method as claimed in claim 2, characterized in that the second pressure lies between 6 and 20 bar.

7. The method as claimed in claim 1, characterized in that the first fluid is injected under a first pressure of at least 350 bar.

8. The method as claimed in claim 1, characterized in that the nozzles co-rotate with the drill head during injection of the first fluid.

9. The method as claimed in claim 1, characterized in that the first fluid comprises water.

10. The method as claimed in claim 1, wherein arranging a borehole casing in the ground includes resting the borehole casing on the ground.

11. The method as claimed in claim 1, characterized in that the first fluid is injected under a first pressure of at least 500 bar.

12. The method as claimed in claim 1, characterized in that the first fluid is injected under a first pressure of at least 650 bar.

13. A device for drilling shafts in ground layers consisting of rock, clay and/or related materials, comprising a borehole casing and an arranger for arranging the borehole casing in the ground in a manner such that it admits substantially no water on its underside, a hollow drill string which can be arranged in the borehole casing and is provided with a drill head with cutting tools, a flow element for maintaining a water column in the borehole casing, and a rotator for setting the drill string into rotation in the borehole casing and for discharging dislodged ground material using the flow maintained by the water column in the hollow drill string, wherein the device comprises one or more nozzles for injecting a first fluid under a first pressure of at least 200 bar into the ground layers at the position of the drill head, the nozzles being directed outward, such that they are each configured for injecting the first fluid into ground layers situated at a greater depth than a lower outer end of the borehole casing to at least partially remove or weaken the ground at a position of an underside of the borehole casing such that the borehole casing can move deeper into the ground.

14. The device as claimed in claim 13, characterized in that the device comprises an injector for injecting a second fluid under a second pressure into the hollow drill string at the position of the drill head.

15. The device as claimed in claim 14, characterized in that the injector for injecting the second fluid under a second pressure into the hollow drill string is suitable for a second pressure lying between 2 and 50 bar.

16. The device as claimed in claim 14, characterized in that the injector for injecting the second fluid under a second pressure into the hollow drill string is suitable for a second pressure lying between 4 and 30 bar.

17. The device as claimed in claim 14, characterized in that the injector for injecting the second fluid under a second pressure into the hollow drill string is suitable for a second pressure lying between 6 and 20 bar.

18. The device as claimed in claim 13, characterized in that the nozzles are suitable for injecting the first fluid under a first pressure of at least 350 bar.

19. The device as claimed in claim 13, characterized in that the nozzles are mounted on the drill head string.

20. The device as claimed in claim 13, characterized in that the diameter of the borehole casing amounts to at least 1 m.

21. The device as claimed in claim 13, characterized in that the drill string and/or the borehole casing and/or the drill head are provided with conduits for injecting the first and/or a second fluid.

22. A jack-up pontoon provided with a device as claimed in claim 13.

23. The device as claimed in claim 13, wherein the borehole casing rests on the ground during drilling.

24. The device as claimed in claim 13, characterized in that the nozzles are suitable for injecting the first fluid under a first pressure of at least 500 bar.

25. The device as claimed in claim 13, characterized in that the nozzles are suitable for injecting the first fluid under a first pressure of at least 650 bar.

* * * * *